US005186981A

United States Patent [19]

Shellhamer et al.

[11] Patent Number: 5,186,981

[45] Date of Patent: Feb. 16, 1993

[54] ROLLERS FOR PRESTRETCH FILM OVERWRAP

[75] Inventors: Terry M. Shellhamer; James C. Ward, both of Louisville, Ky.; David M. Edwards, Corydon, Ind.

[73] Assignee: Lantech, Inc., Louisville, Ky.

[21] Appl. No.: 289,442

[22] Filed: Dec. 22, 1988

Related U.S. Application Data

[63] Continuation of Ser. No. 894,482, Aug. 11, 1986, abandoned, which is a continuation of Ser. No. 665,530, Oct. 26, 1984, abandoned.

[51] Int. Cl.[5] ..... B05D 5/00

[52] U.S. Cl. ..... 427/247; 427/245; 427/292; 427/289; 427/314; 427/318; 427/327; 427/358; 427/430.1; 427/435

[58] Field of Search ..... 427/245, 247, 292, 327, 427/409, 314, 289, 318, 435, 430.1, 35.8, 119; 29/110, 132, 527.1, 460, 527.2; 226/193, 190

[56] References Cited

U.S. PATENT DOCUMENTS

| | | | |
|---|---|---|---|
| 2,586,887 | 2/1952 | Van Gaver | 427/245 |
| 2,631,358 | 3/1953 | Hill | 29/132 |
| 2,753,577 | 7/1956 | Van Clief | 29/132 |
| 3,514,312 | 5/1970 | Gardiner | 427/292 |
| 3,587,153 | 6/1971 | Blickenderfer et al. | 29/132 |
| 3,611,028 | 10/1971 | Whitmore | 29/132 |
| 3,786,549 | 1/1974 | Pott | 29/132 |
| 4,335,857 | 6/1982 | Pfost et al. | 242/192 |

FOREIGN PATENT DOCUMENTS

| | | | |
|---|---|---|---|
| 0084796 | 5/1983 | Japan | 29/132 |

*Primary Examiner*—Janyce Bell

*Attorney, Agent, or Firm*—Finnegan, Henderson, Farabow, Garrett & Dunner

[57] ABSTRACT

A coated roller for transportation and stretching of plastic film web during load unitization, and a process for preparation of the coated roller. A cylindrical metallic roller core is pitted by blasting, then primed, heated and immersed in a room-temperature liquid plastisol comprising vinyl particles dissolved in a plasticizer. The plastisol accumulates on the hot metal to a depth determined by immersion time. After removal, curing and cooling the coated core is machined by lathe to expose a cellular infrastructure and achieve a cylindrical coating coaxial with the core. The coated roller exhibits superior durability, resistance to tackifier additive buildup, and resistance to circumferential web slippage during web stretch between two rollers in a film path from a supply roll to a load being wrapped.

14 Claims, 5 Drawing Sheets

ROLLERS FOR PRESTRETCH FILM OVERWRAP

This application is a continuation of application Ser. No. 894,482, filed Aug. 11, 1986 which is a continuation of application Ser. No. 665,530 filed Oct. 26, 1984 both now abandoned.

BACKGROUND OF THE INVENTION

The present invention relates generally to the art of wrapping loads with a stretchable plastic sheet of film, and more specifically to a roller structure especially adapted for precise, uniform transportation and stretching of plastic sheet of film during the wrapping process between the dispenser roll and the load.

Case packing or boxing is a common way of shipping multiple unit products. The multiple unit products are generally stacked in a corrugated box or are wrapped with kraft paper with the ends of the kraft paper being glued or taped. Another way of shipping such products is by putting a sleeve or covering of heat shrinkable film around the products and shrinking the sleeve to form a unitized package. The use of heat shrinkable film is described in U.S. Pat. No(s). 3,793,798; 3,626,645; 3,590,509; and 3,514,920. A discussion of this art is set forth in U.S. Pat. No. 3,867,806.

Another common method of wrapping load is with rotary stretch wrapping machines. These rotary machines are commonly referred to as spiral or full-web machines, and can operate with the load rotating to pull stretched film web around it. Alternatively, the load can be stationary and stretched film wrapped around the load with a rotating film dispenser.

A typical film-web apparatus is disclosed in U.S. Pat. No. 3,867,806.

The use of spiral wrapping machinery is well known in the art and representative machines are typified by U.S. Pat. No(s). 3,003,297; 3,788,199; 3,683,425; and 4,136,501.

Additional references of interest which are pertinent to rotatable drives for wrapping packages are disclosed in U.S. Pat. No(s). 3,820,451; 3,331,312; 3,324,789; 3,309,839; 3,207,060; 2,743,562; 2,630,751; 2,330,629; 2,054,603 and 2,124,770.

The film stretching means on many currently marketed pallet stretch wrapping devices employ either direct or indirect friction to restrict the film as it is being wound onto the load during the wrapping process. The restriction is either applied to the roll of film itself (direct friction) or applied to the film after it is unwound from the film roll (indirect friction). The pallet and load serve as the winding mandrel providing all of the pulling force required to elongate the film.

The earliest type of stretch wrapper utilizes a direct friction device in the form of a brake that is connected to the core of the film roll. The torque from the friction brake device acts on the center of the film roll and as the diameter of the roll is reduced, the voltage to the brake is altered, either by the operator or automatically by a sensing device. A later film roll brake device, illustrated by U.S. Pat. No. 4,077,179, and FIG. 2 herein, utilizes a frictional brake attached to a shaft with a roller which is pressed against the freely mounted film roll. The film roll brake eliminates the need to change the brake force during the consumption of the film roll.

Various prior art indirect friction film stretching devices have been employed to restrict the film as it is wound onto the pallet during the wrapping process.

One of these devices, commonly referred to as an "S" type roller device, utilizes an idle roller followed by a braked roller over which the film is threaded prior to wrapping the load. The function of the idle roller is to align the film for maximum contact with the braked roller. Another indirect friction device having fixed bars was marketed by Radient Engineering Corporation under the trade name POS-A-TENSIONER and has been subsequently marketed by the Kaufman Company under the trade name TNT. This device has a series of fixed, non-rotating bars positioned adjacent to the film roll. The film web is threaded around the bars whose relative angles can be changed for ultimate tensioning. As the film web is drawn to the pallet it passes across the bars, and the friction between the film and the smooth surface of the bars provides a restriction causing the film to stretch. This device uses multiple bars with the film web stretching incrementally between each bar. Neck down of the film web increases between each bar and the load bears the force. As the load rotates, the wrap angle changes from the last bar so that the wrapping force greatly varies depending on the relative angles. The frictional restraint is determined by the vector of the film web on each bar. Thus, the device is very sensitive to the force placed on the supply roll, and the force increases as the roll size decreases, adding additional force on the system. Furthermore, there must be some friction placed on the supply roll to prevent backlash. While this device solves to some degree the irregularities of the brake and hostility of the film roll, it can only apply limited stretch to the load and does not handle different film compositions with any degree of standardization.

Another stretch wrapper device was introduced by the Anderson Company at the PMMI Show in Chicago in 1978. This device interconnects the turntable drive motor with a pair of nip rollers immediately downstream from the film supply roll. The nip rollers are synchronously driven with the turntable rotation through a variable transmission which could be increased or decreased in speed relative to the turntable rotation speed. Thus the stretch on the film was effected between the nip rollers and the pallet load. It is not known if this machine was ever commercialized, principally because of its inability to achieve satisfactory stretch over the load corners due to its failure to respond to the speed change that these corners represented. The pallet load, as the film accumulating mandrel, provided the total force that was required to stretch the film from the driven nip rollers with all of the stretch occurring after the passage of the single pair of nip rollers to the pallet.

In addition to the previously noted prior art, direct friction pallet stretch wrapping machines of the pass through type have been manufactured by Weldotron and Arenco (Model No. MIPAC). These machines have a significant problem in stretching the film and normally stretch film around the load in an elongation range of about five to ten percent. These machines depend on being able to drive the pallet and associated load through a stretch curtain of film to place the stretching force on the front or sides of the load. Since most pallet loads will not hold together while being subjected to these unequal forces, the film web is normally tensioned after the film seal jaws begin their inward travel over the end of the pallet load. This form of tensioning severely reduces the maximum degree of film elongation and pulls excess film around the two rear corners of the load while the jaws are closing. This frequently causes film tears when the film is stretched more than ten percent.

When low stretch rates of one to ten percent are produced, several packaging problems occur. The unitizing containment forces on the load are less than the optimum force which can be obtained. The minimal containment forces can result in a potential loosening of the film wrap during shipment when the load settles and moves together thereby reducing the girth.

French Pat. No. 2,281,275 assigned to SAT discloses the pre-stretching of plastic film by taking the film web from the film roll through a powered roller system having a speed differential of $V_2$-$V_1$ which stretches the film. The film leaving the second set of rollers is drawn off at a speed which is equal to or less than $V_2$, the speed of the stretched film coming off of the second roller assembly.

The French Patent achieves film web stretch with various problems. The system requires manual operation or complex automatic feedback to accommodate the changes in film take-up speed as the pallet load surfaces pass by the downstream rollers. This reference does not teach the benefit of stretching the film above the yield point with increased strength per cross-sectional area and increase in modulus. There is furthermore no teaching of reducing the force on the portion of the film web between the downstream powered rollers and the load with inelastic strain recovery as a technique for reducing wrapping force while holding high levels of elongation.

A commercial model based on FIG. 8 of the '275 reference has been marketed by SAT. In this embodiment the film web is pre-stretched by extending a pair of rollers forward while braking the film rolls. The load is carried into the pre-stretched "U" shaped sleeve and the rollers are transported behind the load allowing the sleeve to engage the load. Sealer bars are then projected inward to seal the web ends together.

The aforementioned stretching devices do not maintain a consistent force in stretching the film web. These brake devices are subject to variation due to their physical construction and their sensitivity to speed change caused by passage of corners of the load and the resultant sudden speed-up and slow-down of film drawn from the feed roll.

The elasticity of the stretched plastic film holds the products of the load under more tension than either the shrink wrap or the kraft wrap, particularly with products which settle when packaged. The effectiveness of stretch plastic film in holding a load together is a function of the containment or stretch force being placed on the load and the ultimate strength of the total layered film wrap. These two functions are determined by the modulus or hardness of the film after stretch has taken place and the ultimate strength of the film after application. Containment force is currently achieved by maximizing elongation until just below a critical point where breaking of the film occurs. Virtually all stretch film on the market today including products of Mobil Chemical Company (Mobil-X, Mobil-C and Mobil-H), Borden Resinite Devision PS-26, Consolidated Thermoplastic, Presto, PPD and others are consistently stretched less than the manufacturer's laboratory rated capacity which frequently is in excess of three hundred percent.

This problem of obtaining less stretch on commercial wrapping than that available under laboratory conditions centers on several facts. A square or rectangular pallet which is typically positioned off of its center of rotation is used as the wind up mandrel for the purpose of stretching film. A typical 40"×48" pallet positioned 3 to 4 inches off of its center of rotation will experience a speed change of up to 60% within one quarter revolution of the turntable.

In addition to the off centering problem, most pallet loads are irregular in shape with vertical profiles which produce a significant puncture hazard to highly stretched film being wound around them. Further, some unit loads are very susceptible to crushing forces of the stretched film. Because of pallet load changes and inconsistencies within the film roll, the operator typically continues to reduce the tension settings until there are no failures. Thus the inconsistencies of films, stretching devices, and pallet loads produce an environment where very few stretch films are actually stretched to their optimum yield.

The major problem with prior stretch technology is that stretch is produced by frictional force devices to restrict the film travel between two relatively hostile bodies. On the one hand the film roll is subject to edge wandering and feathering, while on the other hand the rotating pallet with its irregular edges and rapidly changing wind-up speeds severely limits the level of elongation achieved. The ultimate holding forces of the film cannot be brought to bear on the load because the film cannot be stretched enough. Even if the film could be stretched enough the high wrapping forces can disrupt or crush many unit loads. The use of high modulus films, such as oriented films, does not produce the yield benefits of the current invention, since these higher modulus films would have to be significantly stretched in order to achieve the rubber band effect and moldability required for irregular loads.

It therefore can be understood, since the pallet provides the forces for stretching the film, that stretch percentages achieved on the pallet and the stretch force achieved are intertwined in all prior art devices. As previously indicated, high stretch percentages are required to achieve the benefits of high yield but the high stretch forces necessary for these high stretch percentages cause premature film rupture and potential crushing of the load.

In an attempt to solve the aforementioned problems several other devices have been developed.

One film stretching device called the powered stretch embodiment stretches the film web above its yield point between two sets of powered rollers prior to transporting the film to the pallet, increasing its modulus while reducing its cross-sectional area.

Since the film stretches between the rollers, all stretching action is isolated from the roll and the pallet. It also moves the dependence of the stretch force and elongation level. While the device can be used to wrap light or crushable loads it has several problems in actual use. The controls necessary to compensate for the interacting speed changes are very complex and prohibitively expensive. Thus, the device generally will require feedback controls to sense force change and maintain the force level.

Another known device manufactured by Lantech Inc., under the trademark "ROLLER STRETCH" utilizes the film web to drive the apparatus. This device addresses several of the aforementioned problems. Since the film is pre-stretched between the rollers, it isolates the stretching action from both the film roll and pallet load. This device provides a consistent level of stretch and, most importantly, responds to force and speed changes without complex feedback controls. A problem inherent with the ROLLER STRETCH device is that it has a dependence between the percentage of stretch that can be achieved and the stretch force for a given elongation level. This is due to the mechanical advantage between the film driven rollers.

A further development is disclosed in U.S. Pat. No. 4,387,552 assigned to Lantech, Inc. In this apparatus film web is drawn from a supply roll and across the surfaces of two rollers by rotation of the load to be wrapped to which the leading edge of the film web is attached. The rollers are geared for proportional rates of rotation, and their speeds are varied by the varying take up of film web at the non-symmetrical load surface. A torque is contributed to the downstream roller so that the mutual force exerted on the load and the film web at the load is reduced, thereby minimizing the risk of film web rupture and of load collapse. The ratio of the gears between the rollers is selected so that the film web is stretched over its yield point, which provides a substantial film material costs savings as well as improved holding strength on the load.

The rollers utilized in the film web path between the supply roller and the load have commonly been adapted from those used in the conveyor industry as lagging head pulleys to drive endless conveyor belts. These rollers are coated with neoprene, urethane, or solid plastisol. However, experimentation and commercial usage have revealed that these roller structures do not provide durability and performance consistency, and so impede the desired use of the wrapping systems to unitize loads at maximum throughput while avoiding film rupture and load collapse.

Neoprene-coated rollers have been prepared using a vulcanizing process. Neoprene is typically obtained in sheet form approximately of the thickness desired in the ultimate coating around the roller. Such sheets are wrapped around the roller core, baked until adjacent neoprene portions and edges melt and merge, and then allowed to cool. The resulting surface is irregular in cross section, and must be machined to obtain a cylindrical surface centered on the axis of the underlying core. The surface exposed by machining is a smooth non-porous surface.

With neoprene-coated rollers, film under tension puts cuts and grooves in the plastic surface of the roller. Various portions of the roller surface can be damaged when the supply roll is exchanged for a shorter or longer one corresponding to wider or narrower film web, because the edges of the film cause a significant portion of the damage. Also, the film web supply roll and pre-stretch rollers are moved along their vertical axes in spiral pallet wrapping systems while the film web is dispensed to create a spiral wrap pattern about the load. This complex motion introduces additional forces on the web at the rollers which contributes to a more complex wear pattern. Ultimately, the neoprene is worn away to expose the metallic roller core. Variations in the wear pattern on the rollers introduce corresponding variations in effective roller diameter and, therefore, variations in lengthwise film stretch. Thus the film web may be stretched at a higher or lower percentage between adjacent bands or strips along the length of the web, and certain film web portions become more prone to rupture than others. The lack of uniformity impedes operation of the wrapping procedure at maximum efficiency.

Urethane rollers have been prepared using a mold process. Urethane is commonly delivered as a binary formulation comprising a base and a blowing agent which are mixed immediately prior to use. The mixture process is considered critical for proper end results: together with the details of the formulation, the mixture can control an extremely broad range of characteristics of the final plastic product. Mixing is normally conducted in an automated device, although small amounts can be prepared by hand and such manual activities is considered a skilled art form conducted by experts. After mixture is completed, the substance is heated and poured into a heated mold surrounding the roller core. The mold and core are maintained in place until cool and the mold is then separated so that the coated core may be removed.

The deficiency of urethane-coated rollers relates to the chemical formulation of the film web itself. Many popular webs for wrapping include an additive which promotes the ability of the web to cling to itself. This tackiness additive provides the commercial advantage of being able to seal a completed overwrap merely by wiping a severed trailing end against an underlying layer of the same material. In many situations this is considered a reliable and economical manner of sealing a package. However, tackiness additives collect on urethane-coated pre-stretch rollers in a random and non-uniform pattern. As a result, film moving across the rollers during wrapping does not depart from the roller surface at a tangent as would be expected in an ideal system. Rather, each surface point of any given film web cross-section deposits a portion of its own tackiness additive to the roller and adheres to the roller for some distance beyond the tangent point. Moreover, that distance may not be the same as the corresponding distance for adjacent portions of the cross-section. The film web therefore experiences varying radial forces relative to the axis of the roller as well as varying tangential forces which stretch the film web. As a further result, a large proportion of film web failures experienced during pre-stretch wrapping arise between the two pre-stretch rollers rather than upstream from the first or downstream from the second. Each such failure requires the machine operator to cease the wrapping procedure and re-thread the film web. Therefore, the failure also contributes to economic inefficiency.

In response to the difficulties evident in the prior art, another type of roller coating was developed. This coating was a plastisol obtained from MR Plastics and Coatings, and is known as Mystaflex 428-V. This substance provides a coating with a hardness rating in the range of 70 to 80 durometer. Therefore it exhibits improved resistance to wear over that which had been experienced with neoprene. Plastisol is delivered as a liquid at room temperature, and the roller core is heated and then dipped into the liquid. The length of time during which the roller is submerged in the liquid plastisol determines the thickness of the coating which results. The coating surface is initially neither perfectly cylindrical nor centered on the axis of the underlying roller. Therefore, the surface is machined to achieve the desired coaxial cylinder surface. In this prior art coating, the surface after machining was smooth and nonporous, reflecting the fact that this and most plastisols are uniformly solid throughout. Further, the roller was machined to produce circumferential, circular grooves which increased friction by allowing web to partially collapse into the grooves. However, these grooves do not contact film web so no tackiness additive can build up therein. This reduced the tendency of the film web to stick to the roller past the point of tangent separation, but only for film over the grooves. Film still slipped around the roller circumference and ruptured frequently. Ultimately, use of such a solid plastisol coated roller was shown to be acceptable for only a narrow class of film formulations and wrapping operation modes. Variation of the width and spacing of the grooves on the rollers was required in order to accommodate different film types or differing wrapping machines. This clearly results in inefficiency of machine manufacture which is passed on to the customer in the form of higher purchase prices for the machines, because inventory control is required to place the proper roller on the proper machine. Further, the customer would be locked into a particular film formulation, and would be required to buy new rollers if the customer elected to use a less expensive or more versatile film formulation in the future. It should also be noted that tackiness additive built up on the portion of the roller which was in contact with film web.

It has also been determined that all types of prior art rollers permit slippage of film web across the circumference of the rollers during the pre-stretch stage of film web application to a load. The pattern of slippage varies both along the length of the rollers and from one revolution of the rollers to the next. This slippage reduces the overall stretch of film web and further contributes to economic waste. Because the slippage varies during wrapping, operators cannot rely on their own adjustments to prevent film web rupture at high throughput, and so must reduce the stretch ratio and the web output speed to build in a safety margin.

Many of these problems arise due to the non-uniform nature of the film web. Although any commercial roll of web appears undifferentiated to the eye, there are actually significant variations in thickness and material phase across any given cross-section in contact with a roller. Thicker regions cause adjacent thinner regions to stand off the roller, thus reducing the ability of the roller to isolate forces on an upstream web portion from forces on a downstream web portion. The smooth, continuous surfaces of the prior art rollers distribute compression from thick web regions too broadly, so the roller surface deflects minimally and the thick web regions never sink in enough to allow contact of adjacent thin regions with the roller surface. When thin regions stand off, web is stretched by forces both upstream and downstream of the roller. There are also significant variations in the material phase across any given cross-section in contact with a roller: some local regions are more crystalline and brittle while other adjacent regions are more amorphous and pliable. Amorphous regions elongate more rapidly than adjacent crystalline regions. Under extremely high forces, such as when thin web sections stand off from the roller, the transition interface between a rapidly-stretching amorphous region and a resistant crystalline region is very often the site of film web rupture.

It can be appreciated that the combination of surface wear, tackiness additive buildup, circumferential slippage, and film web adherence to the surface has significantly contributed to the frequency of film web failure and resultant down time, and it has also stimulated the operator response of reducing the wrapping system operating speed and film web stretch ratio in order to minimize failures. It is therefore clear that there exists a need in the prior art to improve the structure of pre-stretch rollers so that system performance is more reliable and consistent, permitting higher speeds and higher levels of pre-stretch on the web.

SUMMARY OF THE INVENTION

The present invention provides a novel pre-stretch roller structure and a novel method for creating the pre-stretch roller structure. Such a roller exhibits high durability, low attraction to tackiness additives of film web, a high coefficient of friction to prevent lengthwise film slippage around the circumference of the roller, and highly consistent tangential film release with corresponding minimal forces perpendicular to the film and radial to the roller. In short, the rollers promote faster pre-stretch wrapping, higher levels of stretch, and less down time due to film rupture. Further, the novel roller structure provides these advantages with a wide variety of film web formulations in many wrapping machines, eliminating the wasteful requirement for customization and inventory control in the prior art.

The novel roller structure of the present invention comprises a roller, such as a hot rolled welded steel tubing, with an eleven gauge steel end plate welded about its entire circumference to the ends of the tube. The cylindrical surface of the tube is coated with a cellular plastic. Plastisol is normally prepared with smooth, non-porous surfaces and a solid infrastructure. In the present invention, a cellular infrastructure is developed, and the infrastructure is exposed by machining away the outer surface of a roller coated with plastisol. The smooth surface side of the sheet remains bonded to the cylindrical surface of the core, which is previously blasted with G50 steel grit for a period of time sufficient to render the cylindrical surface porous. The core is dipped in liquid plastisol and cured at moderately high temperature. The smooth exterior of the coating is then stripped by rotating the roller on its axis between lathe-type knives or cutting edges which may be moved along the length of the roller during rotation so that the entire smooth plastisol surface is detached.

The resulting porous, cellular plastisol surface of the roller has been tested in commercial system operation and found to provide superior resistance to linear slippage across the circumference of the roller by providing a high coefficient of friction with the film web material. The plastisol material also rejects depositation of tackiness additive from the film web material, so that the web tends not to adhere to the roller circumference past the tangential point of ideal separation of the film web from the roller surface. The cellular plastisol surface of the pre-stretch roller has also exhibited durability far superior to that known for prior art rollers coated with solid plastisol, urethane or neoprene.

The cellular structure of the coating provided by the present invention deflects under compression from thick local regions of film web, thus bringing thinner regions into contact with the coating surface. Isolation of upstream and downstream forces on the film web is therefore maintained. High forces can be developed between an upstream roller and a downstream roller with minimal space therebetween, so that the total linear shear exerted on any phase transition interface will not be so great as to cause a film web rupture. Preferably, the number of cells in the film web per unit of linear measure greatly exceeds the average linear size of film web variations.

These and other objects and advantages of the present invention will become more readily apparent in the following detailed description thereof taken in conjunction with the drawings appended hereto.

DETAILED DESCRIPTION OF THE PREFERRED EMBODIMENT

Figure 1:
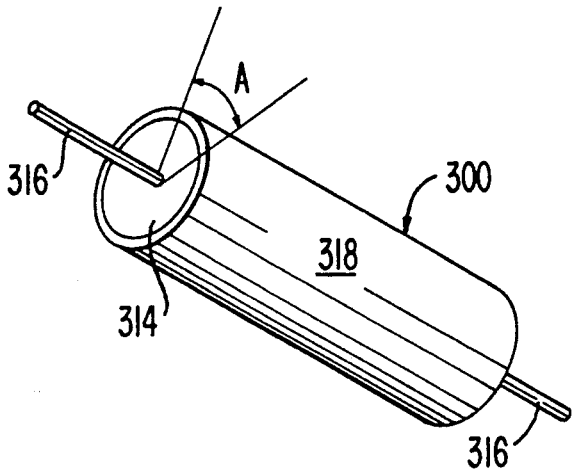
FIG. 1 is a perspective view of a film transport roller constructed according to the present invention.
Figure 2:
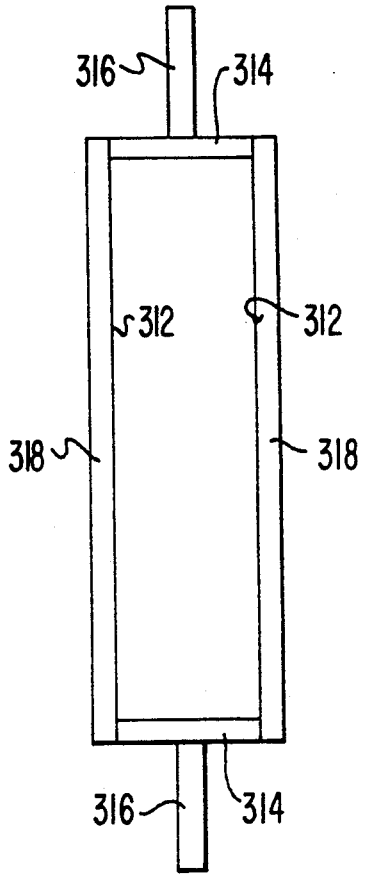
FIG. 2 is a side view of the roller of FIG. 1, with internal elements shown in phantom.
Figure 3:
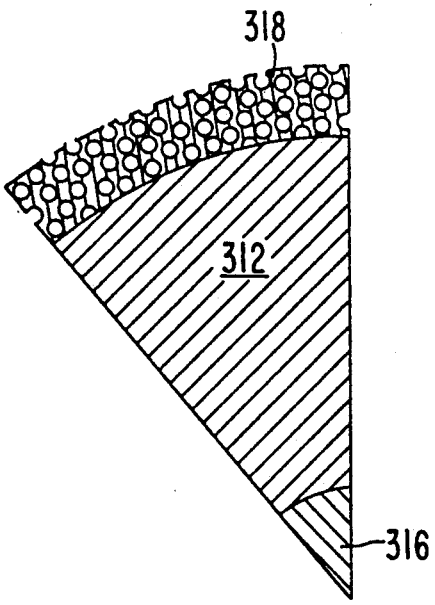
FIG. 3 is an isolated top plan view of a portion of the roller taken from arc A of FIG. 1.
Figure 5:
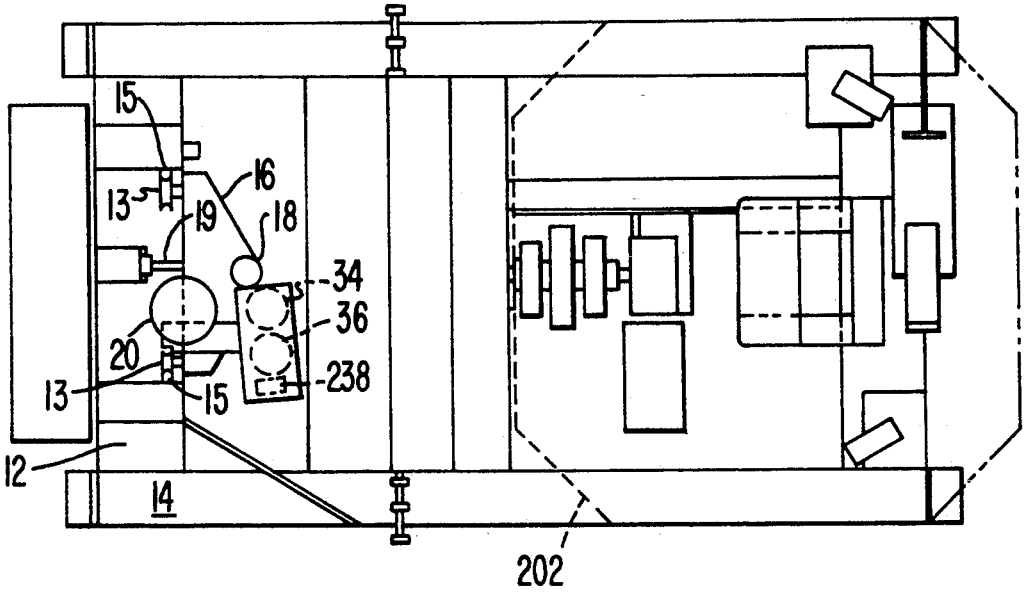
FIG. 5 is a top plan view of the wrapping apparatus of FIG. 4.
Figure 4:
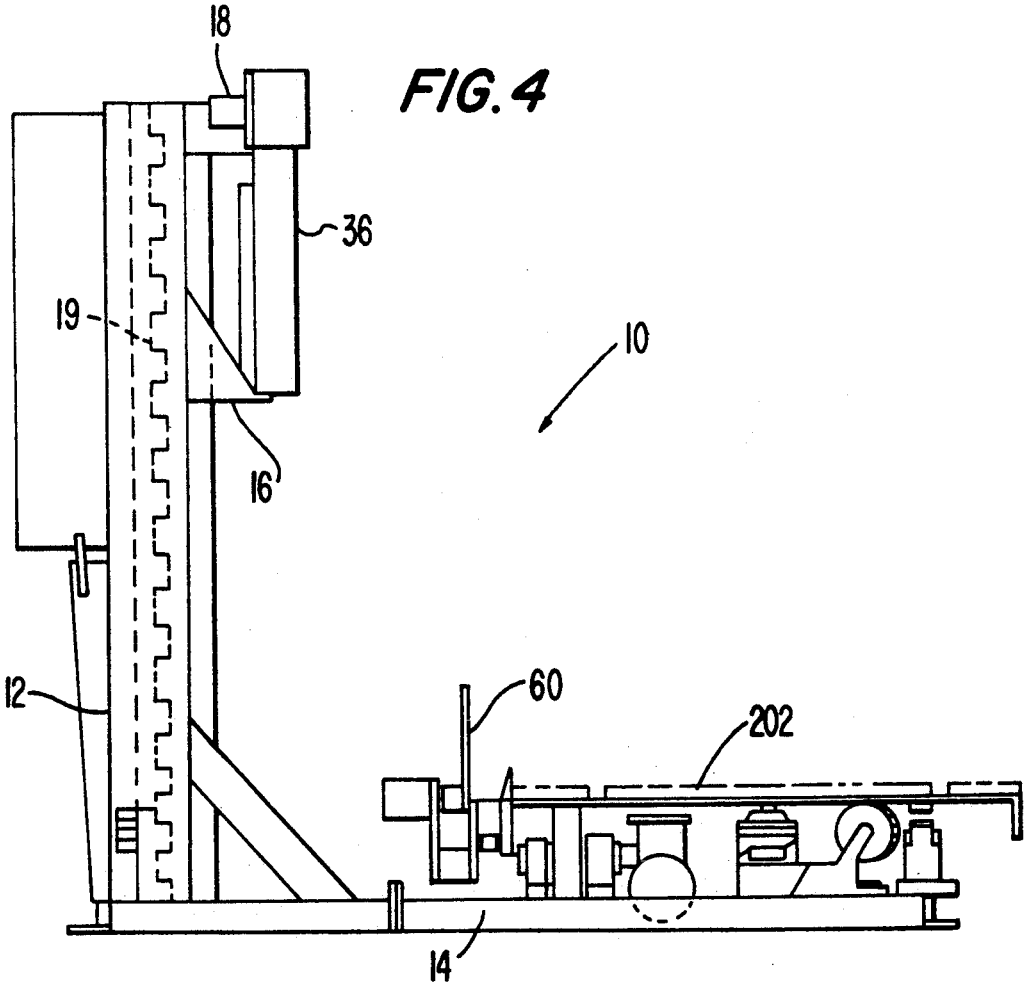
FIG. 4 is a side elevational view of a prestretch wrapping apparatus incorporating a roller constructed according to the present invention.
Figure 9:
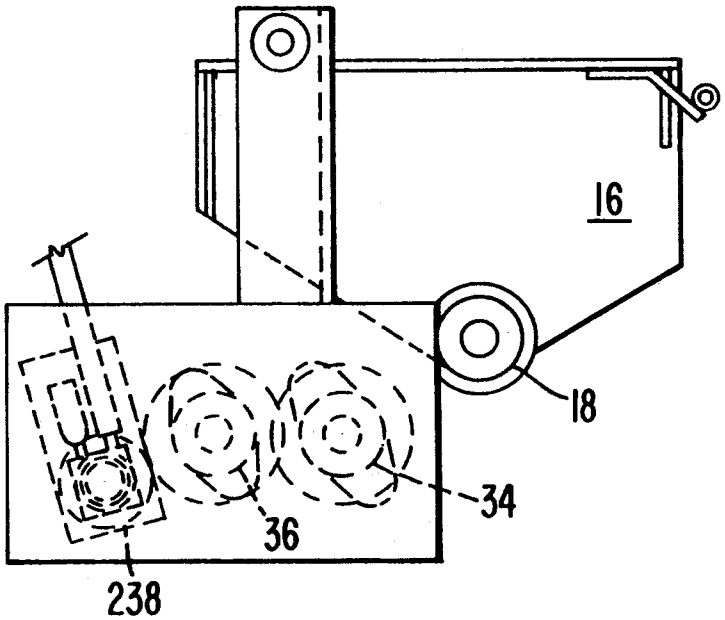
FIG. 9 is a top plan view of the film prestretching assembly shown in FIG. 7.
Figure 6:
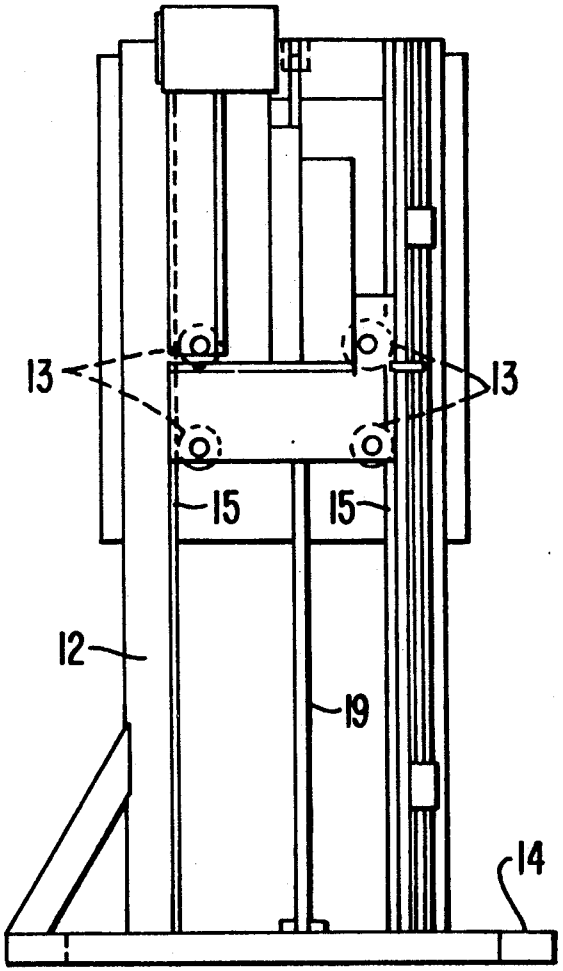
FIG. 6 is an isolated front elevational view, with turntable omitted, of the wrapping apparatus of FIG. 4.
Figure 8:
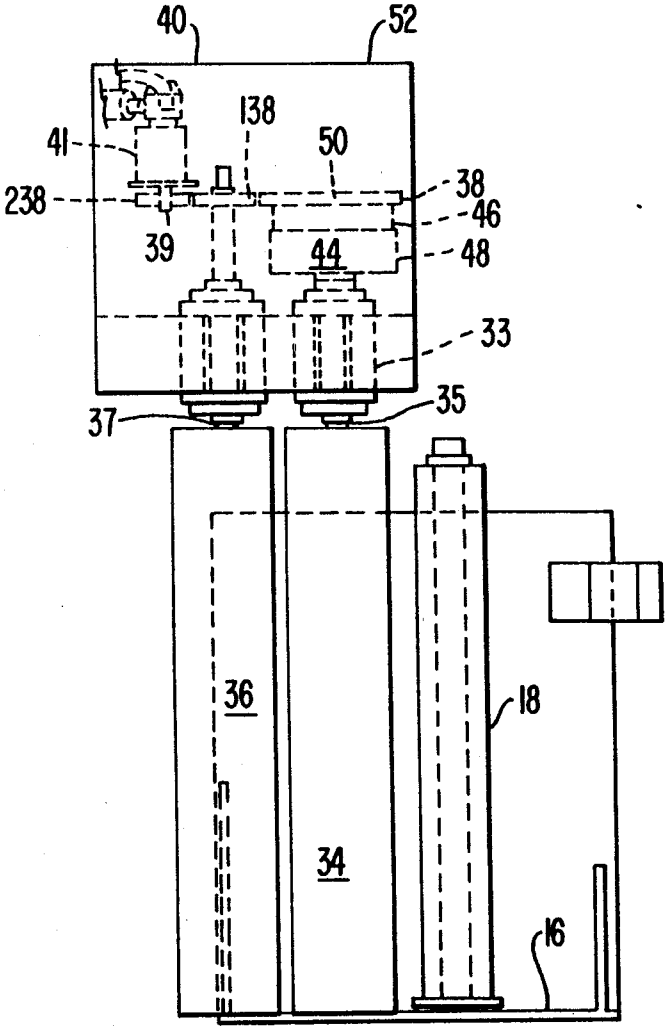
FIG. 8 is a front elevational view of the film prestretching assembly of FIG. 7.
Figure 7:
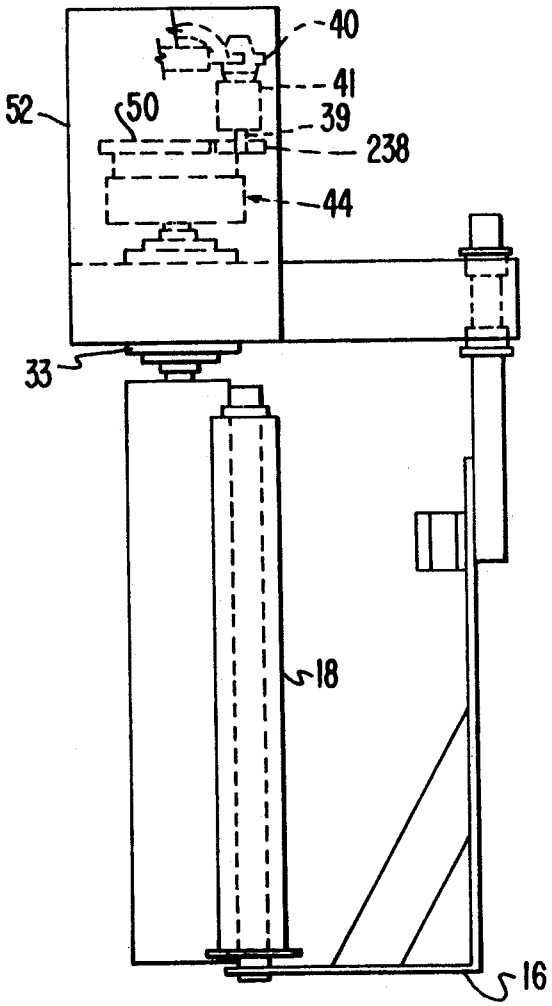
FIG. 7 is an enlarged isolated side elevational view of the film prestretching assembly of the wrapping apparatus of FIG. 4.
Figure 12:
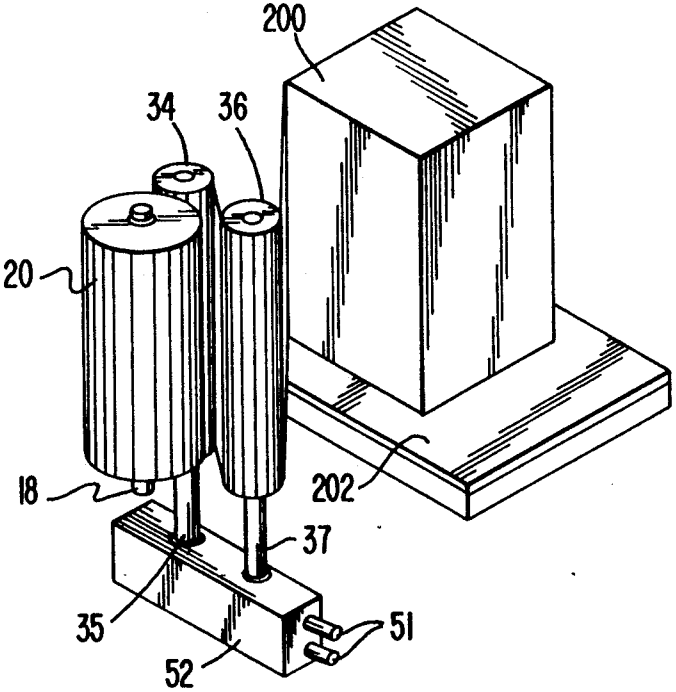
FIG. 12 is an elevated perspective view of the apparatus of FIG. 11.
Figure 11:
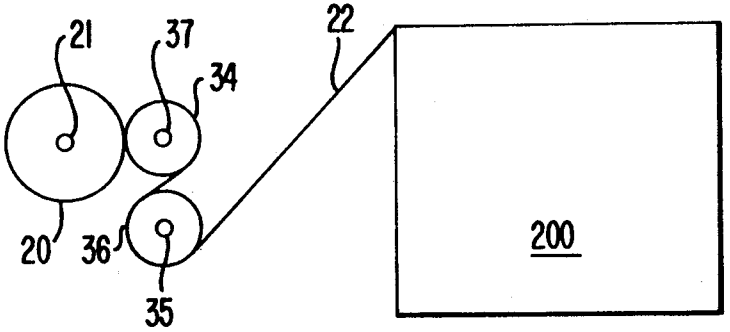
FIG. 11 is an isolated schematic top plan view of the wrapping apparatus of FIG. 5.
Figure 10:
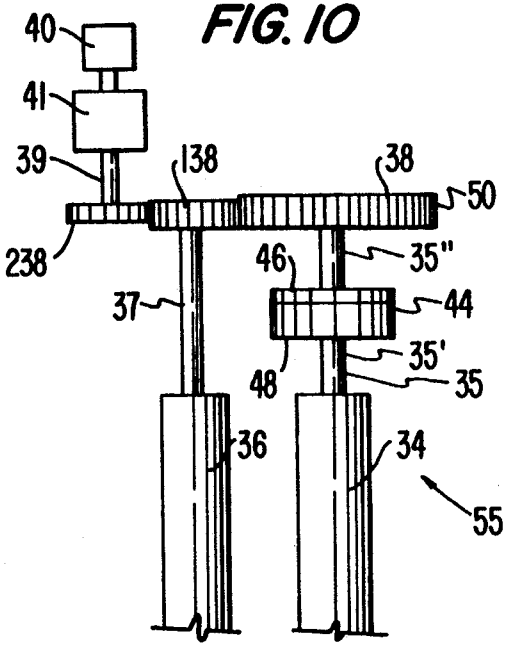
FIG. 10 is an isolated partial front elevational view with casing removed, of the film prestretching assembly of FIG. 7.

The presently preferred embodiment and best mode of the present invention is illustrated in FIGS. 1 through 3. In the figures it can be seen that the pre-stretch roller structure, generally indicated at 300, comprises a cylindrical core 312. End caps 314 are secured to each end of the cylindrical core 312, preferably by welding completely around the circumference of the end cap. The length of the cylindrical core is selected to exceed the tallest roll of sheet film utilized in the art of pre-stretch film web packaging, which today is 48 inches.

The exterior surface of the core 312 is prepared for application of a coating 318 by rotation of the core 312 on its axis and blasting the exterior surface with G50 steel grit for a period of 15 minutes. It is after this operation that the end plate should be welded to the core, and the axle shafts 316 should be welded to the center end of each plate and in line with the axis of the cylindrical core 312. At the completion of this operation, the concentricity of the core should be 0.020. The blasted pitted core surface should then be degreased.

Any commercial solvent may be utilized to wipe the blasted surface to remove grit. Coating 318 preferably comprises a plastisol commercially available from Dennis Chemical Company of St. Louis identified as PX-5565-B containing 30–60% phthalate ester plasticizer, 30–60% wt. polyvinyl chloride resin, 1–5% wt. barium/cadmium PVC stabilizer mixture, less than 1% wt. black pigment, and less than 1% wt. foam blowing agent and having a boiling range of 500–700° F. and a specific gravity of 1.18. This plastisol product is a room temperature liquid comprising particulate vinyl dissolved in a plasticizer. In accordance with this preference, after solvent has been wiped on the surface of the core 312, Dennis 2392 primer containing 30–60% wt. diacetone alcohol, 10–30% wt. 2-methoxyethanol, and 10–30% wt. methylethylketone and having a boiling range of 175–345° F. and a specific gravity of 0.96 should be brushed on the surface. This primer is thinned with Denflex 4600 epoxy thinner to a watery consistency prior to application to the exterior of the core 312. Although these products are delivered from Dennis with broad directions for hot dip, cold dip and preparation of a cellular coating, the present inventive process is much more stringent than those stated parameters in order to achieve uniform cellular structure.

In the following steps, it should be noted that the proper development of the uniform cellular infrastructure of coating 318 is highly dependent on a close adherence to the stated range of temperature and time for each step. All temperatures are stated in the Fahrenheit scale.

After application of the thinned primer to the core 312, a convection oven should be set to a temperature of 345° plus or minus 5°, and the core is then hanged in the oven for a period of 25 minutes.

Following the 25 minute pre-heating period, plastisol is applied to the exterior of the core 312. Plastisol is a hot dip vinyl coating, and the hot core 312 is removed from the oven and submerged into the liquid plastisol. The core must be held submerged because it is hollow and will float if not so held. At the same time, the core 312 must be kept free of contact with other surfaces such as the container for the liquid vinyl. The core 312 should be held submerged for a preferred period of 3.5 minutes. Alternately the core 312 can be held submerged for a period ranging from 3 to 4 minutes. The core is then removed and allowed to drain until dripping stops.

Following the dipping step, the coated core is cured in the convection oven. The core is loaded into the oven and is suspended on the axle shafts 16 in a horizontal orientation. There should be no contact of the coated exterior of the core 12 with any other surface. The oven is maintained in the range of 345° plus or minus 5° for a time of 16 to 18 minutes. Following this heat exposure, the roller is removed from the oven and hung for cooling. Following temperature reduction to room temperature, the coating is removed from the non-primed surfaces such as the end caps 314 and the axle shafts 316.

At this stage, the plastisol coating 318 exhibits a smooth surface which is unacceptable for use in a prestretch system. In order to prepare the surface of the coating 318, the axle shafts 316 are mounted on the center line in a lathe, such as a 5C collect lathe drive with a 1 inch tapered roller in a tail stock adapter. The outer diameter of the coating 318 is then turned to reach the desired outer diameter. It has been found that a speed of 360 revolutions per minute and a feed rate of 0.030 inches is acceptable for this purpose. As the smooth surface is stripped by the lathe from the roller, it can be seen that an underlying porous, cellular structure of the coating 318 is revealed. The machining process provides a cellular coating thickness of at least $\frac{1}{8}$ inch and preferably of $\frac{1}{8}$ inch to $\frac{1}{4}$ inch, cylindrical in shape and coaxial with the rotation axis of the core. Proper curing produces cells of uniform size ranging from 36 to 44, per linear inch. However cells ranging from 20 to 100 per linear inch can be used. Following the completion of the turning step, the roller is ready to be mounted in a prestretch system and utilized for film web transportation and tension stretching.

Deviation from the heating time and temperature parameters stated above will result in specific coating failures, the characteristics of which can be used to identify the parameter adjustment necessary for correction. If the plastisol material is undercured, it will generally adhere to a core but provides only a solid, continuous structure without cells. If the plastisol material is overcured, the coating will not consistently adhere to the roller, and machining will reveal voids and widely varying cell size in the structure of the coating below the smooth surface. The coating may also tend to shrink circumferentially so that it does not cover the entire circumference of the roller.

Rollers with proper coatings as set forth above find use in prestretch wrapping machinery such as that shown in FIGS. 6 through 12. The film web driven stretch wrapping apparatus 10 comprises an upright frame 12 sitting on a base 14. A carriage 16 is movably mounted on the frame 12 by means of rollers 13 rotatably mounted on tracks 15 secured to the frame. The carriage has a motor 17 mounted on it to provide the power for a rack and pinion drive 19. However, chain or other suitable drive means can be used. These drive means are well known in the art and are typified by machine Model Nos. SVS-80, SVSM-80, STVS-80, STVSM-80 and SAHS-80 manufactured by Lantech, Inc. The apparatus 10 may also be a full-web apparatus with the carriage removed as is well known in the art. Such machines are typified by machine Model Nos. S-65, SV-65 and SAH-70 manufactured by Lantech, Inc.

A film unwind stand 18 which is well known in the art is mounted on the carriage 16 or base 14 in the case of a full-web machine. The stand is constructed with sufficient drag to allow smooth film to unwind without backlashing from film roll 20 to a first roller 34 which is mechanically connected by a gear assembly 50 to a second roller 36. The rollers 34 and 36 are closely spaced together preferably in the range of ¼ inch to 2 inches, and geared for reverse rotation. This close relationship of the rollers prevents significant neckdown of the film with the stress/strain curve on the film being substantially higher than the curve where film is allowed to freely neck down during stretching. Both rollers 34 and 36 comprise a roller 300 prepared and constructed as set forth above. The rollers are connected by a gear assembly 50, but it should be noted that they could alternatively be connected by chains, belts or other mechanisms (not shown). Since most films, except linear low density polyethylene, reach their yield point before thirty percent elongation, the gear speed relationship should be variable from thirty percent to three hundred percent to allow use on all stretch films which are currently available in the marketplace.

EVA copolymer films of high EVA content such as Consolidated Thermoplastics "RS-50", and PPD "Stay-Tight" are preferably pre-stretched from one hundred thirty percent. PVC films such as Borden Resinite "PS-26" are best pre-stretched at levels of forty percent. Premium films such as Mobil-X, Presto SG-4, Bemis ST-80 and St. Regis utilize a low pressure polymerization process resin manufactured by Union Carbide and Dow Chemical Company. This resin, called linear low density polyethylene, has significantly different stretch characteristics than previous stretch films. These characteristics allow the film to withstand the high stress of over two hundred fifty percent elongation during prestretch without tearing during wrapping of the pallet.

Rollers 34 and 36 are respectively secured to rotatable shafts 35 and 37 which are in turn mounted in respective journals or bearings 33 mounted to the gear housing 52 and carriage 16.

A gear 38 is mounted on shaft 35 and is rotated by the film web 22 driving roller 34. A clutch assembly 44 is also mounted to shaft 35. The clutch assembly is an over-the-counter Warner friction brake PC-500. A clutch plate 46 is mounted to the end of shaft portion 35'' opposite the face of the clutch member 48 secured to the end of shaft portion 35'. When the clutch is operative, pins (not shown) interconnect the clutch plate 46 with the gear 38 engaging the gear member 38 so that it rotates simultaneously with roller 34. When the clutch is not operative or energized, the roller 34 freewheels or turns without relationship to gear 38 thus allowing a film web to be easily threaded through the roller assembly and attached to the load. The use of such clutching mechanisms is well known in the art. Gear 38 is adapted to engage and mesh with an opposing gear 138 mounted on shaft 37. The interconnection of the gears is such that haul off of the film web by the load will drive the downstream gear 138 through interconnected rollers 34 and 36 at a pre-selected ratio for the optimum stretch for the particular film used.

The entire roller assembly 55 can be mounted for rotation about a vertical axis so that the upstream roller 34 can be urged against the film roll to avoid backlash while maintaining very low friction on the unwind shaft.

Opposing gear 138 is further adapted to engage and mesh with a spur gear 238. The spur gear 238 is mounted to a shaft 39 of a standard gear reduction assembly 41 which is connected to an air powered positive torque device 40. The positive torque device 40 when powered by a selected air pressure drives the downstream gear 138 through spur gear 238 to reduce the forces on the film web while the film is being stretched. The interconnection of the positive torque device 40 provides a portion of the force that is required to rotate rollers 34 and 36 and their associated gears 38 and 138. Thus the force placed on the film between the stretching assembly and the pallet can be reduced to an optimum level. The winding force required on the part of the rotating pallet is less than it otherwise would be. The function of the torque device 40 is therefore analogous to power steering in an automobile. Preferably the force between the rollers 34 and 36 is greater than that between the downstream roller 36 and load 200. Since the positive torque device 40 drives gear 138 by adding a constant torque, rather than a constant angular rate, speed changes on the takeup of the film at the load will be transmitted back to the rollers 34 and 36, accelerating and decelerating their rotation in response to the changing effective diameter of the load 200, thus keeping a relatively constant force and stretch level. The constant torque device 40 will allow balance to be achieved at higher film elongation levels than that of the ROLLER STRETCH device which is only driven by the turntable rotated pallet load interconnected to the film web. At the point when the mechanical advantage will not overcome the difference between the amount of force to stretch the film between the rollers and that amount to hold the elongation to the load, the constant torque device becomes essential. The film Mobil-X reaches this balance point at 110% with the ROLLER STRETCH embodiment. Higher gear selections produce secondary stretch without torque assistance. Up to and above 250% gear selections are possible with torque assistance to overcome the higher stretch forces between the rollers. Thus, the torque assist must make up for the loss in mechanical advantage as the gear ratio is increased for higher elongation on the load.

Commercial over-the-counter air motor model nos. 1AM-NRV-56-G and 1AM-NRV-60-GR11 with a 15:1 gear reducer manufactured by Gast Co. have been used as the constant positive torque device 40. However, it should be noted that other known conventional constant positive torque devices may be used with satisfactory results.

In operation, the film web 22 is pulled from the film roll 20, threaded around the two rollers 34 and 36 and then secured to the load 200 by attachment to a clamp 60 mounted to the turntable or by tucking the leading end of the film web into the load. A release system such as clutch assembly 44 can be used to ease the tucking or start up for full-web or high modulus film applications. If desired, the turntable revolution can begin with the turntable clutch disengaged. After passage of at least one corner of the load, the clutch is engaged to connect the gears and rollers to each other at the predetermined gear ratio. Typical gear selections which have been used with the following films are: Mobil-X 250 percent; EVA 150 percent; and LDPE 70 percent. As the turntable 202 rotates, the film web 22 is pulled across the first roller 34 thereby precisely increasing the speed for the second roller 36 to a predetermined ratio controlled by the gear assembly. The connection means can be a gear transmission or any other conventional speed ratio linkage system. The film is thereby precisely elongated by a percentage represented by the relative speed differential of the rollers.

Simultaneously with the engagement of the clutch, the air pressure is connected to the air torque device to assist the roller assembly in stretching the film web to the level represented by the gear ratio reducing the stretch force. The torque assist must make up for the loss in mechanical advantage as the gear ratio is increased for higher elongation on the load.

Alternately, the clutch could remain engaged or be eliminated and the torque device could be pressurized upon the turntable start to relieve pressure on the tuck or clamp.

Before wrapping the load, the air pressure to the powered torque device 40 is set to the desired stretch force, namely a force which does not crush the load or distort it during the wrapping operation, up to the balance point. Typical air pressure to device 40 to assist the film Mobil-X on a very regular load is 40 psi, a slightly irregular load is 60 psi and a very random and irregular load is 80 psi. A spiral or full-web wrap cycle is accomplished on the load in a manner known in the art. Approximately one quarter turn before completion of the last turntable revolution the clutch can be partially or completely disengaged to allow unwinding of selectively less-stretched or unstretched film to prepare to be wiped on a wrap. Air pressure to the torque device is significantly reduced at the same time. This step is undertaken when a film is used which loses its tackiness when it is stretched past the yield point. One such film that behaves in this manner is Mobil-X. Cutting and sealing is performed in a standard known manner. Other films do not lose this tackiness property and can be wiped onto the load or tied to the load as is described in the specification.

Very rapid elongation of the film followed by rapid strain relief of certain films will cause a "memorization" effect. Generally, films exhibit memorization when stretched above the yield point, with the stretch force to the load reduced at least fifty percent from the force within the stretching mechanism, and wrapped on the load at more than 100 linear feet per minute with a dwell time between the stretching assembly and the load of less than one half second. Due to this memory effect, over time the film will significantly increase holding force and conformation to the load. PVC films, such as PS-26 by Borden Resinite Division, demonstrate this memory capacity very significantly. As an example, a 20 inch web of Mobil-X, stretched at 250 percent and power assisted down to thirteen pounds of force, when wrapped on the load shows an increase in force over three minutes. This is the reverse of stress relaxation of over 20 percent in the first three minutes when stretched conventionally. Because of the film's memory, the film will actually continue to shrink for some time after being subjected to the high levels of stretch above the yield point and immediate reduction of force. This film characteristic can be used to wrap loads at very close to zero stretch wrapping force using the memory to build stretch force and load conformity. When film has been assisted by 80 to 90 psi there is a substantial increase in force after three minutes.

The air system positive torque device was selected because of its very low inertial mass, low weight and responsiveness to speed change without torque change. Optimum wrapping results and machine reliability were obtained while keeping the film elongation on the pallet in balance or equal to or less than the elongation incurred between the rollers. At elongations significantly above elongations achieved between the rollers, secondary stretch occurs between the stretching device and the load. This secondary stretch induces significant forces in the film which cause premature zippering of the film on any load irregularity. Furthermore, this secondary stretch increases neck down of the film.

The rollers 34 and 36, when constructed according to the present invention, exhibits superior durability, resistance to tackiness additive, and resistance to circumferential web slippage. Web transported across the cylindrical coating surface during roller rotation separates from the surface more closely to the ideal tangent, and more consistently in one place, than has been known to occur in the prior art. These advantages have been found to accrue for a variety of film web formulations and in a variety of pre-stretch apparatus embodiments, so that the need for a roller configuration customized to the film web and apparatus is eliminated. Thus it can be appreciated that rollers constructed according to the present invention allow acceleration of the wrapping process and achieve greater economies through higher stretch ratios, faster web transportation, and less down time than is found in the prior art.

It should be noted that the steps of the roller construction process can be interchangeable without departing from the scope of the invention. Furthermore, these steps can be interchanged and are equivalent.

In the foregoing description, the invention has been described with reference to a particular preferred embodiment although it is to be understood that the specific details shown are merely illustrative and that the invention may be carried out in other ways without departing from the true spirit and scope of the appended claims.

What is claimed is:

1. A process for making a roller with a textured surface for transporting and stretching a film web comprising:

forming a foamable curable plastic material containing a blowing agent into the shape of a roller;

curing the plastic material containing the blowing agent for a time sufficient for the plastic material to develop an internal cellular structure; and removing an outer layer of the plastic material to expose the internal cellular structure and form a textured surface on the plastic material from the exposed cellular structure for engaging, transporting and releasing a film web.

2. The process as claimed in claim 1, wherein the forming includes the step of coating a core with the plastic material.

3. The process as claimed in claim 2, wherein the coating provides a coating which has a thickness in a range of about 150 inch to ¼ inch.

4. The process as claimed in claim 2, wherein the plastic material is a vinyl plastisol which is lower in temperature than the core, and the coating includes submerging the core in the vinyl plastisol for a period of at least three minutes.

5. The process as claimed in claim 1, wherein the plastic material is a vinyl plastisol.

6. The process as claimed in claim 5, wherein the vinyl plastisol contains 30–60% wt. phthalate ester plasticizer, 30–60% wt. polyvinyl chloride resin, 1–5% wt. barium/cadmium PVC stabilizer mixture, less than 1% wt. black pigment, and less than 1% wt. foam blowing agent and having a boiling range of 500°–700° F. and a specific gravity of 1.18.

7. The process as claimed in claim 1, wherein the forming step further comprises:

forming pits on an exterior surface of a core to accept a primer;

priming the core for adhesion of the plastic material;

heating the core; and coating the core with the plastic material to form a coated core.

8. The process as claimed in claim 7, wherein the heating further comprises heating the core for a period of approximately 25 minutes at a temperature in a range of about 340° to 350° F.

9. The process as claimed in claim 7, wherein the curing includes heating the coated core for a period of about 16 to 18 minutes at a temperature in a range of about 340° to 350° f.

10. The process as claimed in claim 1, wherein the removing includes machining the outer layer of the plastic material.

11. The process as claimed in claim 5, wherein the plastic material of the resulting roller has a hardness in a range of about 70 to 80 durometer.

12. The process as claimed in claim 1, wherein the plastic material of the resulting roller has a hardness in a range of about 70 to 80 durometer.

13. The process as claimed in claim 1, wherein the cellular structure of the plastic material includes cells occurring in a range of about 20 to 100 calls per linear inch.

14. The process as claimed in claim 1, wherein the cellular structure of the plastic material includes cells occurring in a range of about 35 to 44 calls per linear inch.

* * * * *

UNITED STATES PATENT AND TRADEMARK OFFICE

CERTIFICATE OF CORRECTION

PATENT NO. : 5,186,981

DATED : February 16, 1993

INVENTOR(S) : Terry M. Shellhamer et al.

It is certified that error appears in the above-identified patent and that said Letters Patent is hereby corrected as shown below:

Claim 3, column 15, line 23, change "150" to --1/8--.

Claim 9, column 16, line 18, change "350°f" to --350°F--.

Claim 13, column 16, line 30, change "calls" to --cells--.

Claim 14, column 16, line 34, change "calls" to --cells--.

Signed and Sealed this

Sixteenth Day of November, 1993

Bruce Lehman

*Attest:*

BRUCE LEHMAN

*Attesting Officer*

*Commissioner of Patents and Trademarks*